US005867946A

United States Patent [19]

Seagren

[11] Patent Number: 5,867,946

[45] Date of Patent: Feb. 9, 1999

[54] INSULATING COVER FOR ATTIC OPENING

[76] Inventor: Stanley F. Seagren, 3 Antonio Ct., Peekskill, N.Y. 10566

[21] Appl. No.: 915,899

[22] Filed: Aug. 21, 1997

[51] Int. Cl.[6] ..... E02D 29/14

[52] U.S. Cl. ..... 52/19; 52/23; 52/72; 52/309.8; 182/46; 182/81

[58] Field of Search ..... 52/19, 23, 72, 52/309.8; 182/46, 81; 49/463

[56] References Cited

U.S. PATENT DOCUMENTS

| | | | |
|---|---|---|---|
| 4,281,743 | 8/1981 | Fuller | 182/46 |
| 4,312,423 | 1/1982 | Helbig | 182/81 X |
| 4,658,555 | 4/1987 | Steiner | 52/19 X |
| 5,475,955 | 12/1995 | Dickinson | 182/81 X |
| 5,628,151 | 5/1997 | Monat | 52/19 |

*Primary Examiner*—Christopher Todd Kent
*Attorney, Agent, or Firm*—McGlew and Tuttle

[57] ABSTRACT

An attic opening cover and a process for forming the cover are provided. The cover includes a first composite end element including a protective layer bonded to a thermally insulating layer. A second composite end element is provided including a protective layer and a thermal insulating layer. A first composite side element is provided including a protective layer bonded to a thermal insulating layer. A second composite side element is provided including a protective layer bonded to a thermal insulating layer. A composite top element is provided including a protective layer bonded to a thermal insulating layer. A fastening arrangement is provided including fasteners extending through the first composite end element, fasteners extending through the second composite end element, fasteners extending through the first composite side element, fasteners extending through the second composite side element and fasteners extending through the composite top element. The fastening arrangement also includes a plurality of tie elements. Each tie element is connected to fasteners of one of the first and second composite end element, one of the first and second composite side element and the top element for joining together the protective layers of the one of said first and second composite end element, the one of said first and second composite side element and the top element.

13 Claims, 11 Drawing Sheets

TOP VIEW OF 14, A COMPOSITE SIDE ELEMENT

TOP VIEW OF 18, A COMPOSITE SIDE ELEMENT

TOP VIEW
OF 12,
A
COMPOSITE
END
ELEMENT

TOP VIEW
OF 16,
A
COMPOSITE
END
ELEMENT

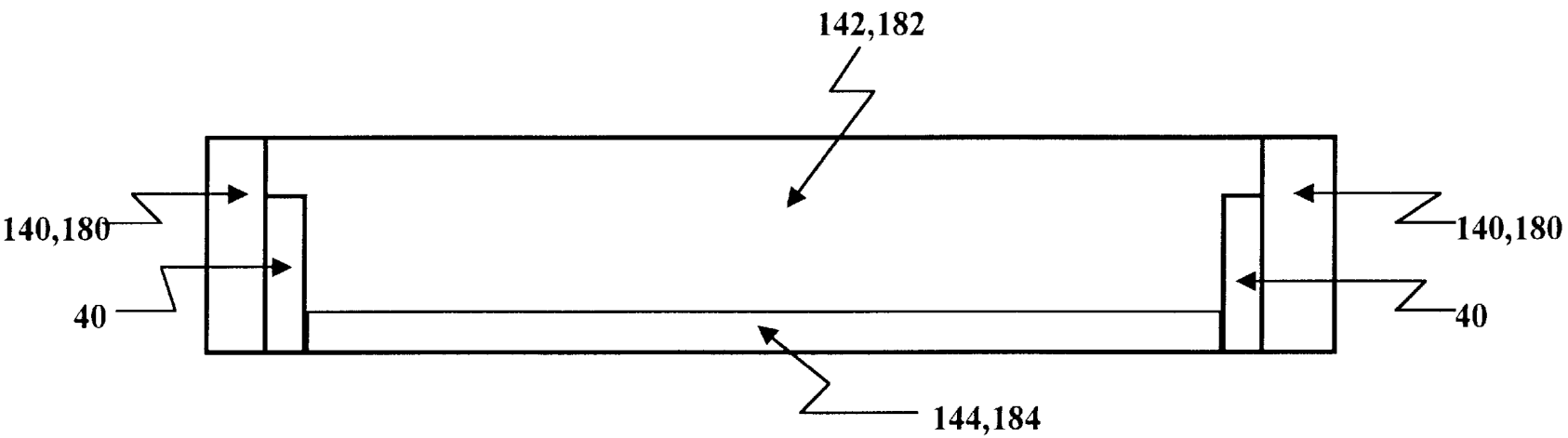
FIGURE 5 - SIDE VIEW SHOWING INTERIOR SIDE OF THE COMPOSITE SIDE ELEMENT 14,18 OF FIGURE 1,3

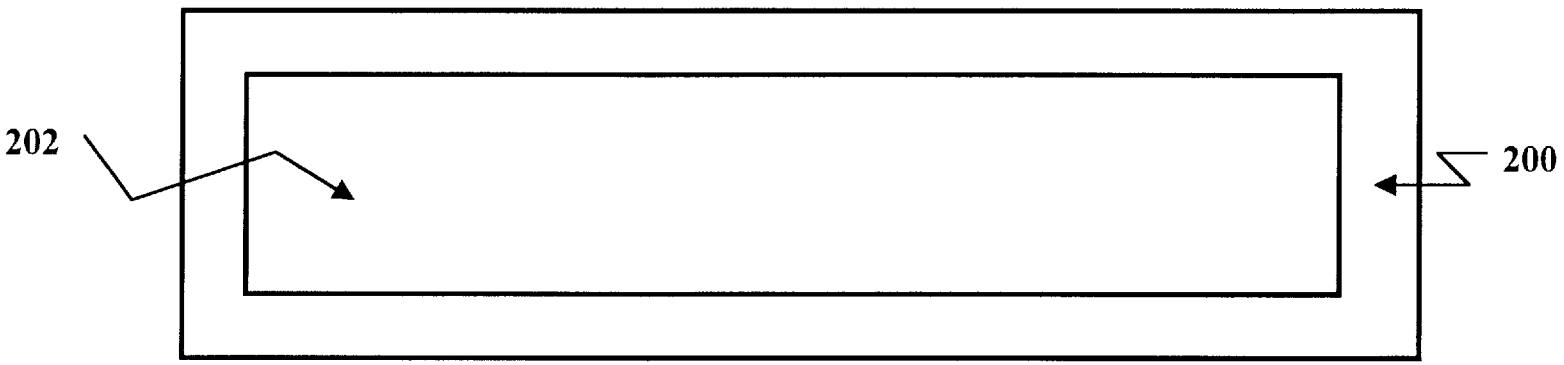
FIGURE 6A - BOTTOM VIEW OF AN INTERIOR SIDE OF 20, THE COMPOSITE TOP ELEMENT

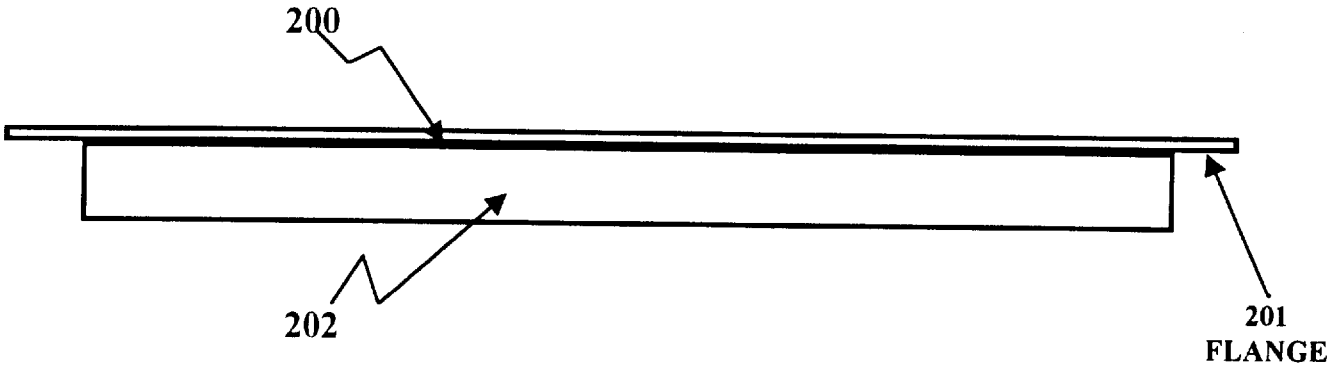
FIGURE 6B- SIDE VIEW OF 20, THE COMPOSITE TOP ELEMENT
SIDE VIEW

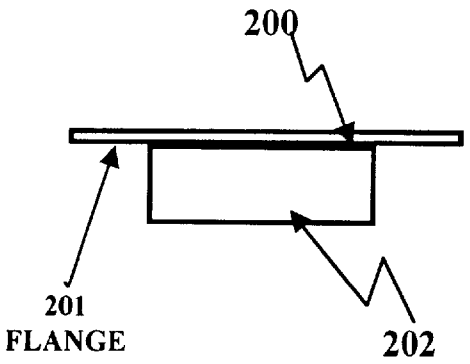
FIGURE 6C- END VIEW OF 20, THE COMPOSITE TOP ELEMENT
END VIEW

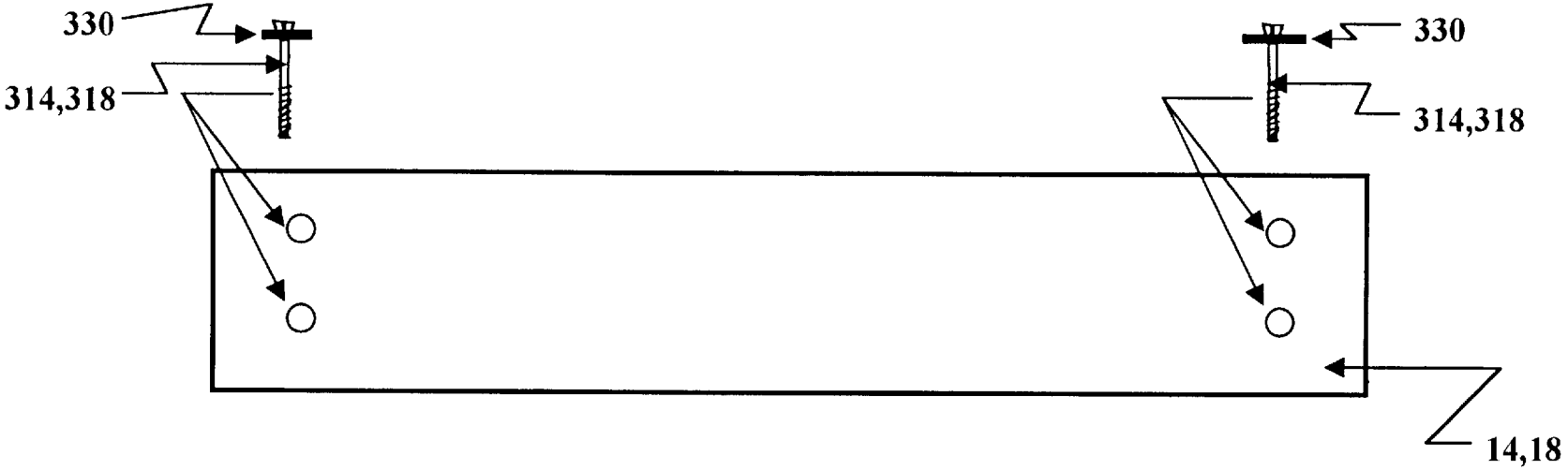
FIGURE 7 - SIDE VIEW OF 10, THE ASSEMBLED COMPOSITE MODULAR UNIT

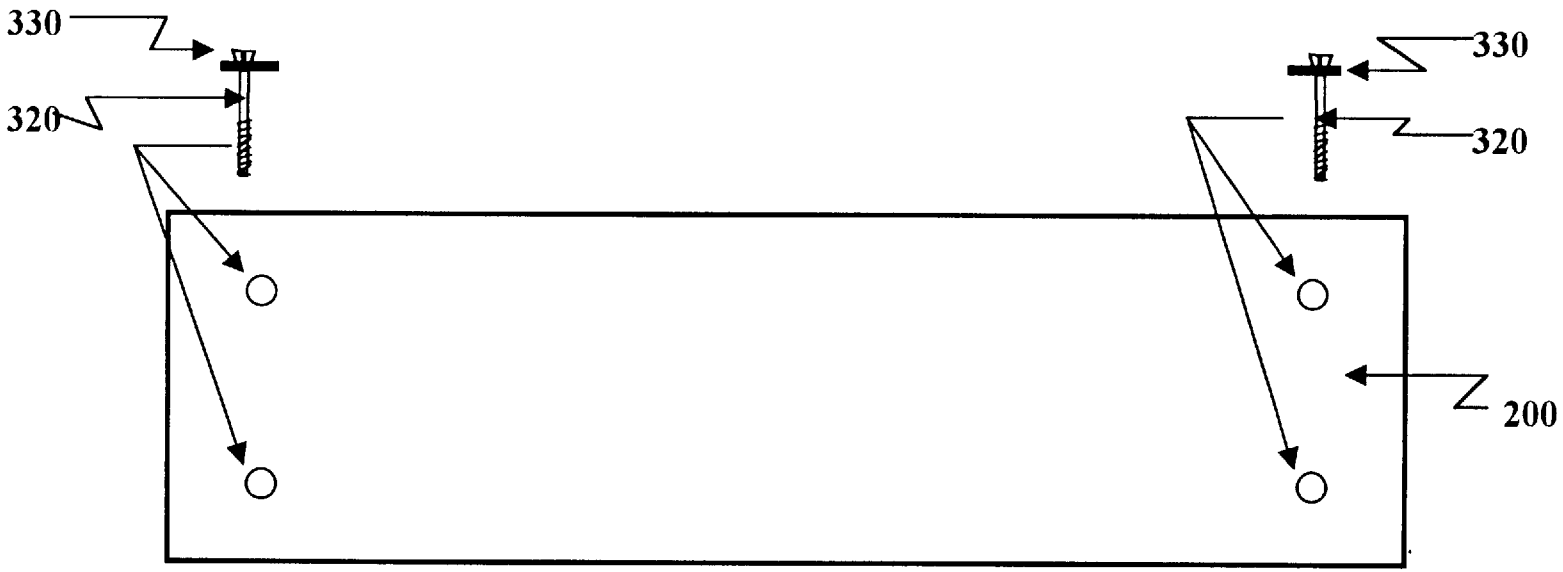
FIGURE 8 - TOP VIEW OF 10, THE ASSEMBLED COMPOSITE MODULAR UNIT

FIGURE 9 - PERSPECTIVE VIEW OF 10, THE ASSEMBLED COMPOSITE MODULAR UNIT
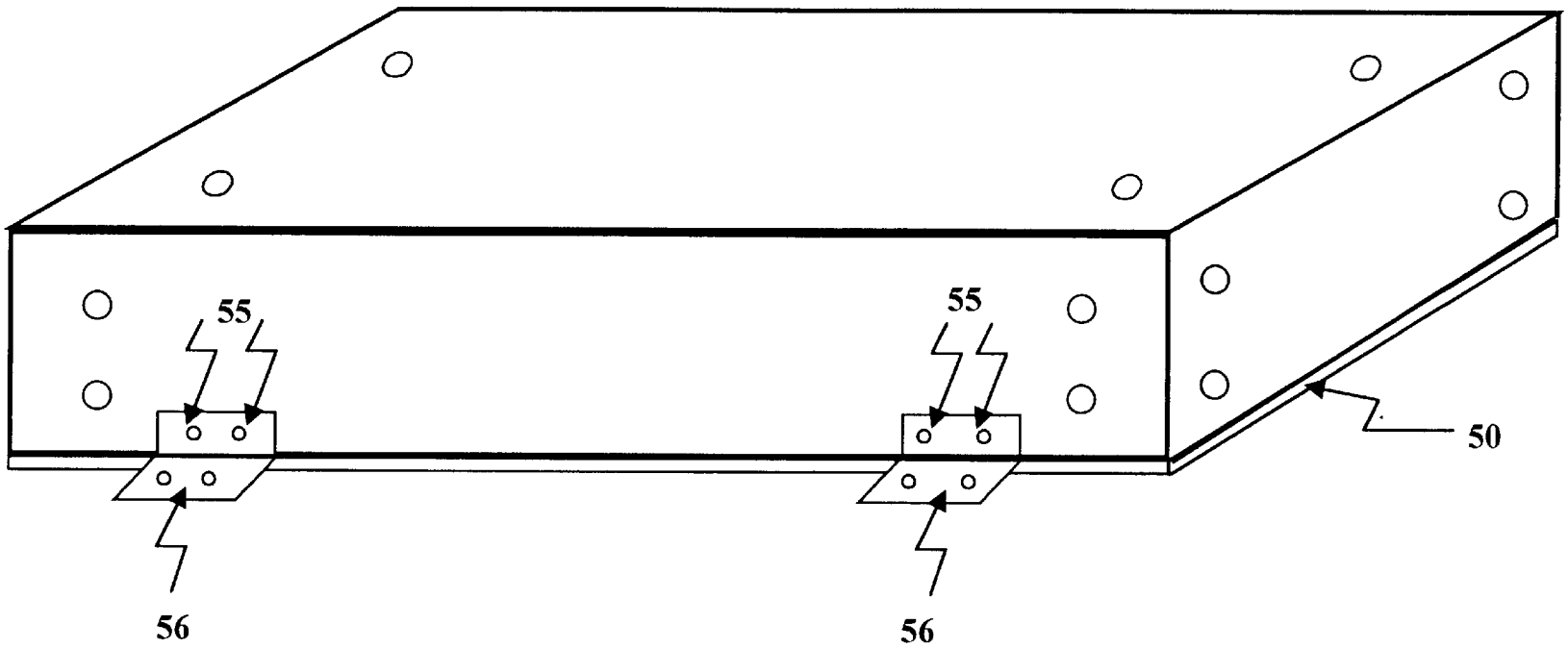

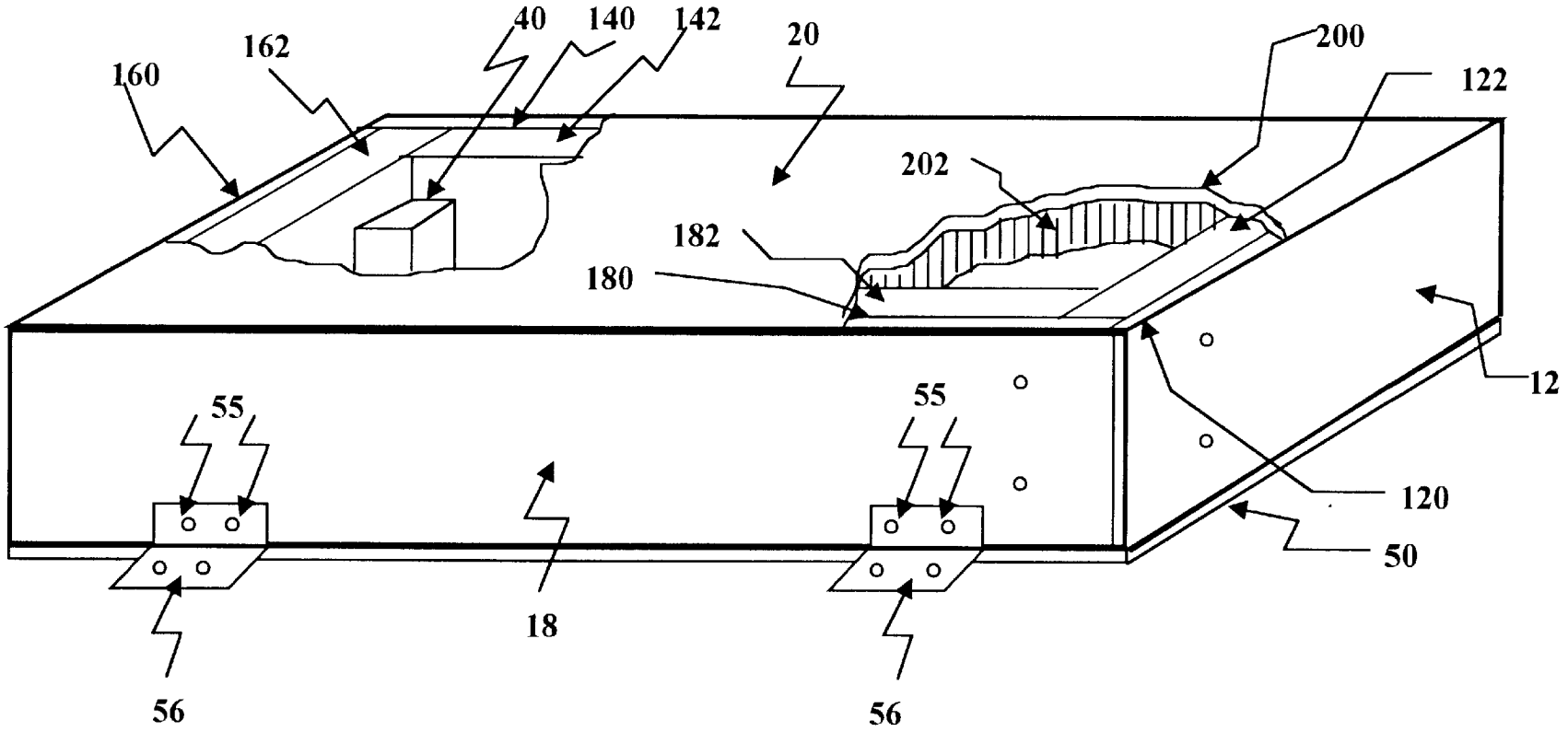
FIGURE 10 - PERSPECTIVE VIEW SIMILAR TO FIGURE 9
BUT SHOWING A PORTION OF THE COMPOSITE TOP ELEMENT CUT AWAY

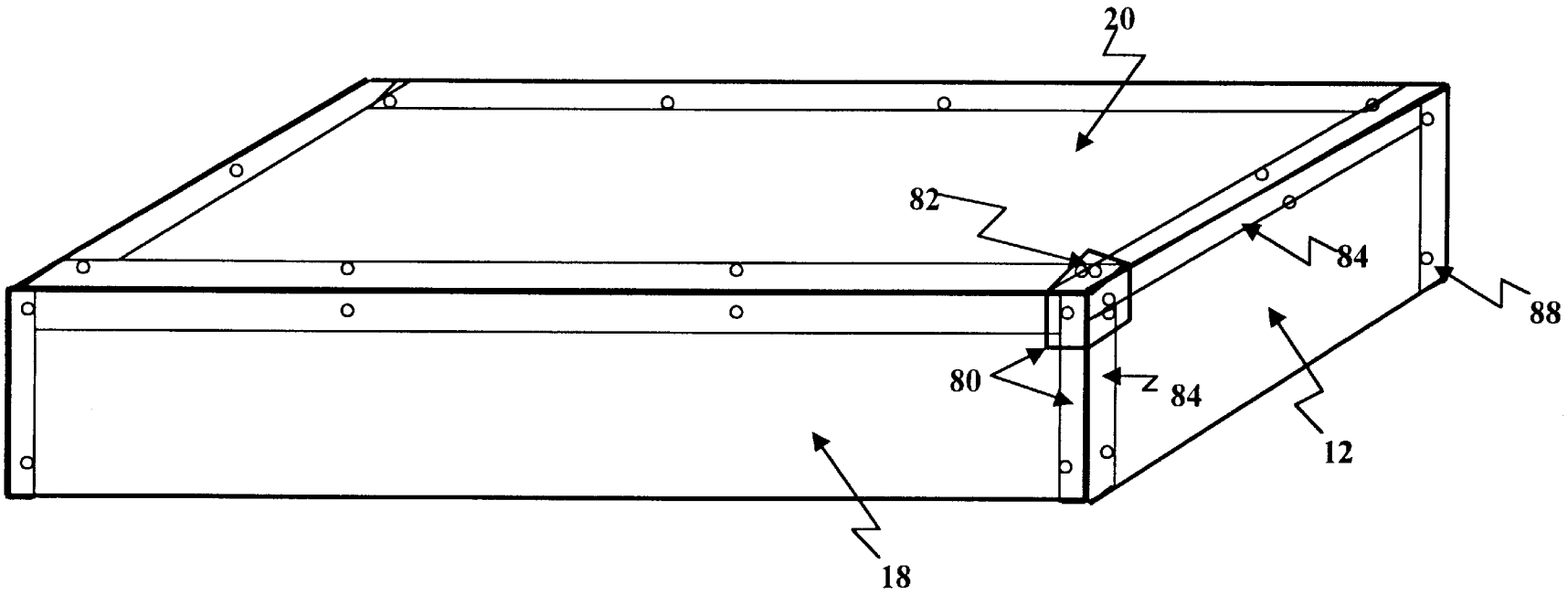
FIGURE 11 - PERSPECTIVE VIEW SHOWING AN ALTERNATIVE EMBODIMENT

INSULATING COVER FOR ATTIC OPENING

FIELD OF THE INVENTION

The invention relates generally to covers for attic openings such as attic stairways, whole house ceiling exhaust fans and the like, and relates more particularly to an insulating cover and a process for producing an insulating cover which allows the use of soft insulating material as a component of the cover.

BACKGROUND OF THE INVENTION

Attics have been insulated to a higher degree over the past several decades, largely due to rising energy costs and heightened awareness of the loss of heated air through the ceiling between living space and attic space. Such attic insulation may be significant in reducing overall heating costs. A substantial amount of energy can be lost from the living spaces of residences to the attic space, above the living space. Generally, the heated air rises, and through either actual air flow or heat transfer, heat escapes from the living space. Where attics are significantly insulated, heat is still transferred through the thin layers which normally provide a barrier between the attic and living space in a region of attic stairs or attic openings. Traditional arrangements even unintentionally allow for air flow through cracks between an attic stair door and a region which defines the attic opening.

Attic insulation covers have been proposed in the past which provide significant barriers as to heat loss through the attic opening space. U.S. Pat. No. 4,550,534 to Mariano et al. discloses a ceiling cover for an attic floor well opening and attic stairs. This cover consists of a dome made of insulated material. Such a dome is basically a single integral unit. This provides significant benefits with regard to preventing heat transfer or preventing heated air flow from the living space to the attic. However, this preformed device can be quite awkward with regard to installation and particularly storage and shipping. As the device is a single piece and cannot be disassembled, a large container is required for shipping the unit. Further, the large size can be quite problematic with regard to installing the cover and moving it through the house. Also the large size requires significant cost in creating the mold, and a separate mold is required for each size opening.

U.S. Pat. No. 4,658,555 discloses an attic hatchway insulating cover which is made of a solid piece of insulation such as cellular foam, having a high thermal "R" value. This foam is rigid and is lightweight. A thin covering can be provided over the foam to protect it from being damaged. Although this structure is less prone to damage as compared to the ceiling cover proposed by Mariano et al., this structure nevertheless still has the problems of Mariano including the problem of the device requiring a large device for shipping and the hatchway being problematic with regard to installation.

U.S. Pat. No. 5,274,966 discloses an insulating cover for attic stair opening which is formed of two pieces made of a strong lightweight insulating material such as polyurethane. The two pieces or two sections combine together to form a single cover. These blow molded elements are still quite large in size and although the structure provides advantages by mounting by hinges, the structure is still quite large and requires large boxes for shipping. It also has the same mold requirements as Mariano.

U.S. Pat. No. 4,832,153 discloses an attic stair insulating cover which is formed of several rigid foam or fiberglass elements. These plurality of pieces are fitted together into an operational position to form the cover. This arrangement provides some advantages with regard to shipping and assembly. However, the units are still quite large and for the most part cannot be provided in a flat state. Instead, large boxes are still required as the various elements still take up quite a bit of volume even in a disassembled state.

The U.S. Pat. No. 4,281,743 discloses an insulating enclosure for an attic stairway. The arrangement includes a plurality of elements which combine to form the enclosure. The enclosure is formed of side members, a side wall and a top wall. A tiny groove connection arrangement is provided for connecting the various elements. Each of the side members, top panels and expansion panels is preferably fabricated from the relatively lightweight material such as polystyrene foam or the like which has good thermal insulating qualities. This structure still relies on L shaped side elements which do not lie flat and requires additional volume when the unassembled pieces are shipped. Further, by forming the structural elements out of polystyrene foam, the assembled device is structurally somewhat weak and potentially prone to damage.

SUMMARY AND OBJECTS OF THE INVENTION

It is an object of the invention to provide an "insulating cover for attic openings" and a process for forming the covers wherein the resulting covers are structurally sound, is not easily damaged, and provides significant thermal insulation while being based on components which lie generally flat to facilitate ease of shipping, assembly and storage.

It is a further object of the invention to provide an attic opening cover which includes substantial insulation but which is based on a construction which is generally robust, does not rely on the insulation material for its structural integrity, and does not require molds.

According to the invention, an attic opening cover is provided including a first composite end element including a protective layer bonded to a thermally insulating layer. A second composite end element is provided including a protective layer and a thermal insulating layer. A first composite side element is provided including a protective layer bonded to a thermal insulating layer. A second composite side element is provided including a protective layer bonded to a thermal insulating layer. A composite top element is provided including a protective layer bonded to a thermal insulating layer. A fastening arrangement or means is provided including fasteners extending through the first composite end element, fasteners extending through the second composite end element, fasteners extending through the first composite side element, fasteners extending through the second composite side element and fasteners extending through the composite top element. The fastening arrangement also includes tie means with a plurality of tie elements. Each tie element is connected to fasteners of one of the first and second composite end element, one of the first and second composite side element and the top element for joining together the protective layers of the one of said first and second composite end element, the one of said first and second composite side element and the top element.

Also according to the invention, a process is provided for providing an attic opening cover. The process includes bonding a thermal insulating member to a protective member to form a first composite end element, bonding a thermal insulating member to a protective member to form a second composite end element, bonding a protective member to an insulating member to provide a first composite side element, bonding a protective member to an insulating member to provide a second composite side element and bonding an insulating member to a protective member to form a composite top element. Tie means including a plurality of tie elements are provided for tieing the composite elements together to for the modular unit. Prefabricated assemblies are first provided by connecting a first tie element and a second tie element to the first composite side element to form a first composite side assembly, connecting a third tie element and a fourth tie element to the second composite side element to provided a second composite side element assembly. The composite top element, the first composite end element, the second composite end element, the first composite side assembly and the second composite side assembly are disposed in a box, disposed substantially flat to provide positioned composite elements and composite assemblies having a minimum height. The method further provides shipping the box with positioned composite elements and composite assemblies to a location and fastening the first composite end element to the first tie element and the third tie element and connecting the second composite end element to the second tie element and the fourth tie element and connecting the composite top element to each of the first tie element, second tie element, third tie element and fourth tie element.

It is a further object of the invention to provide a insulation cover which may be easily removed and stored but which provides significant thermal insulation, significant structural integrity.

It is a further object of the invention to have the protective and insulating members to be substantially planar so that the composite side, end and top elements lie flat for shipping. The protective members providing a majority of the structural strength and rigidity to the cover with the insulating layers providing the majority of the thermal resistance. The protective layers provide the support for the thermal layers. The fastening means is chosen to be small in size compared to the side end and top elements. The fastening elements join the edges of the protective layers to form a box shape with an open side. The inside of the box shape is chosen to have a size large enough to receive and cover either an attic passageway apparatus that provides access to the attic through an opening in the attic floor or an attic fan. The fastening means can include an interior tie means for also helping to bond the insulating layer to the protective layer.

It is still another object of the invention to provide an attic access opening which is simple in design, rugged in construction and economical to manufacture and ship.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is a side view showing an interior side of the composite side elements of FIGS. 1 and 3;

FIGS. 6A, 6B, and 6C are a bottom, side and end view of an interior side of the composite top element according to the invention;

FIG. 7 is a side view of the assembled composite modular unit according to the invention;

FIG. 8 is a top view of the assembled composite modular unit according to the invention;

FIG. 9 is a perspective view of the assembled composite modular unit according to the invention; and FIG. 10 is a perspective view similar to FIG. 9 but showing a portion of the composite top element cut away;

FIG. 11 is a perspective view showing an alternative embodiment according to the invention.

DESCRIPTION OF THE PREFERRED EMBODIMENTS

Figure 1:
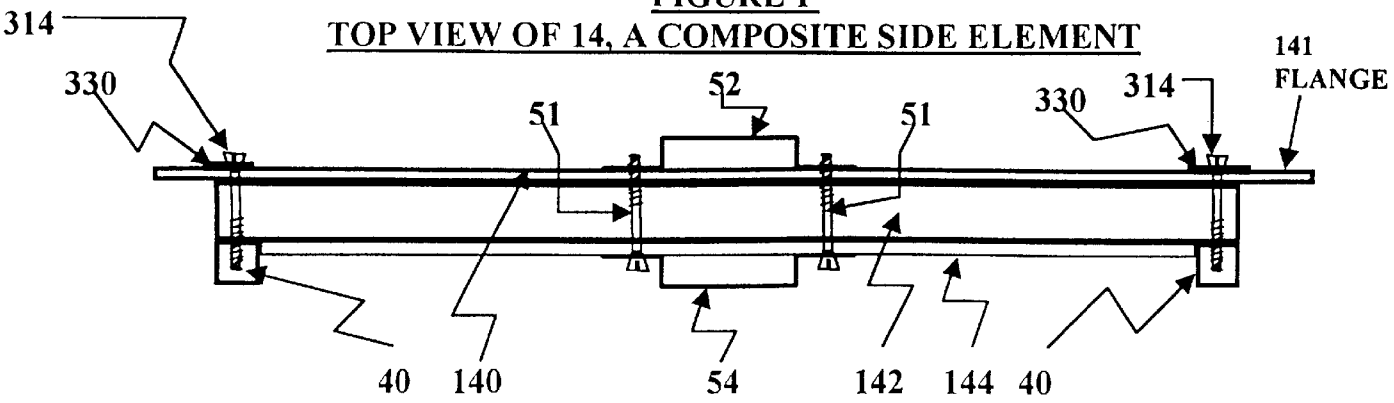
FIG. 1 is a top view of a composite side element according to the invention.

Referring to the drawings in particular, the invention comprises a composite modular unit generally designated 10. The composite modular unit 10 is formed of a first composite end element generally designated 12 (see FIG. 2), a first composite side element generally designated 14 (see FIG. 1), a second composite end element generally designated 16 (see FIG. 4), a second composite side element generally designated 18 (see FIG. 3), and a composite top element 20.

Each composite element includes at least an insulation layer and an exterior protection support layer. Both of which are planar, with the protection preferably providing more structural strength. For example, first composite end element 12 includes a thermally insulating element 122 and an outer protection layer 120. Similarly, the second composite end element 16 includes a thermally insulating layer 162 and an outer protective layer 160. The first composite side element 14 is formed of an outer protective layer 140 and inner thermally insulating layer 142. The second composite side element 18 includes a thermally insulating layer 182 as well as an outer protective layer 180. The composites side elements 14 and 18 preferably also include a handle support element 144 and hinge support element 184 respectively. If the attic opening is for a fan, the handle and hinge support elements 144, 184, fastening elements 51, 55, hinge 56, and handles 52, 54 are not needed.

As can be seen in FIG. 6A, 6B and 6C, the composite top element 20 includes an insulating layer 202 as well as an outer protective layer 200.

Figure 3:
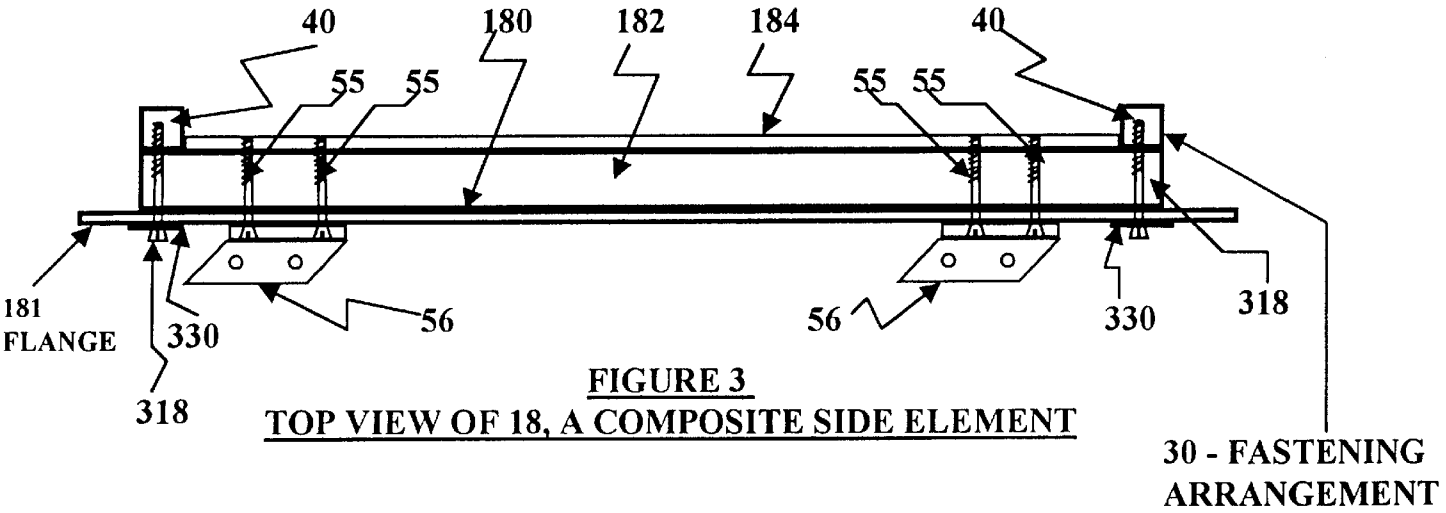
FIG. 3 is a top view of a composite side element according to the invention.
Figure 4:
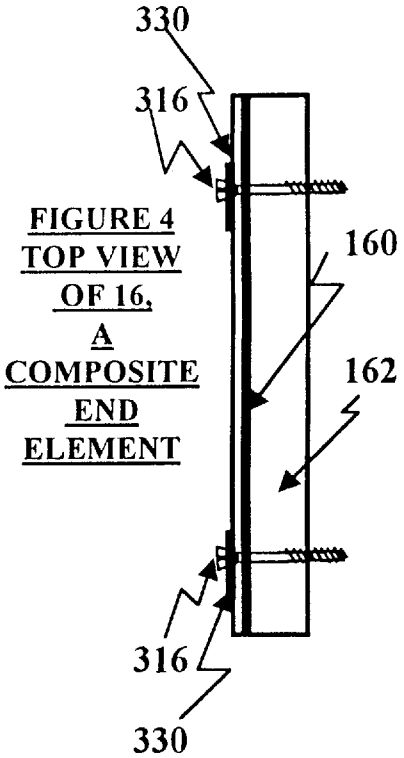
FIG. 4 is a top view of a composite end element according to the invention.

According to the preferred embodiment shown in FIGS. 1 through 11 and detailed in FIG. 3, the invention provides a fastening arrangement 30 which includes tie means 40. The fastening arrangement also includes a plurality of screws or similar fasteners 312, 314, 316, 318, and 320 which cooperate with the tie means 40 and the various composite elements 12, 14, 16, 18 and 20. Preferably also washers 330 are provided. With the use of the fastening arrangement including the tie element 40, an insulating layer such as layers 122, 142, 162, 182 and 202 may be used which does not have very good strength but may have a relatively large dimension relative to the exterior protective layers 120, 140, 160, 180 and 200. Further, by use of a washer in combination with the tie element 40, protective layers 120, 140, 160, 180 and 200 may be relatively thin. The protective layer preferably adds strength to the overall construction and adds some rigidity. However, using the fastening arrangement with tie means 40, the protective layers 120, 140, 160, 180 and 200 need not be overly robust.

Figure 2:
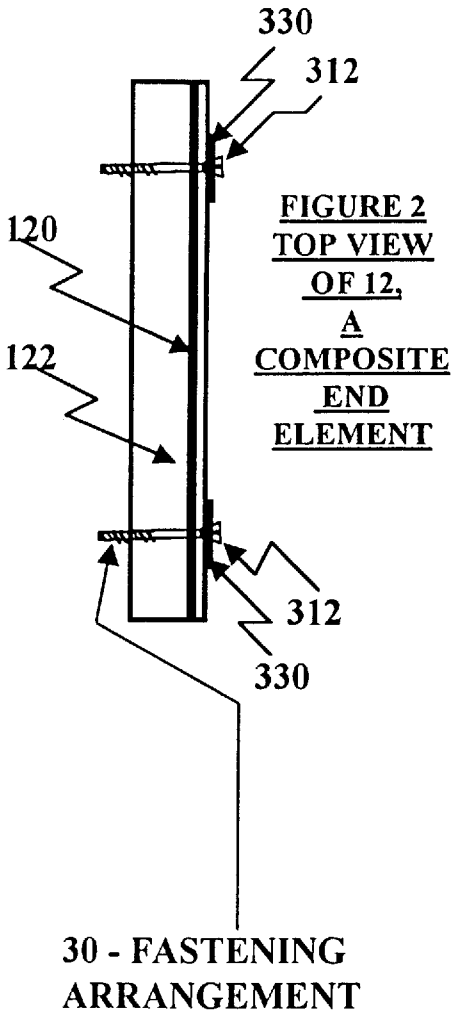
FIG. 2 is a top view of a composite end element according to the invention.

FIG. 5 shows the first composite side element 14 or the second composite side element 18 (these appear the same in the side view). From this view, it can be appreciated that the handle support layer 144 and hinge support layer 184 do not extend over the entire surface of either the insulation layer 142,182 or the outer layers 140, 180 as slayers 140, 180 as shown in FIGS. 1 and 3. Each of the composite side element 14, 18 preferably includes a flange, namely flanges 141 in side element 14 and flanges 181 of side element 18 which is merely an extension of protective layers 140, 180 respectively. As can be appreciated from viewing FIGS. 1 through 4, these flanges allow the exterior protective layers 120, 140, 160 and 180 to be joined at their edges (the flanges allow for the depth of the insulation layers 122 and 162 of composite end elements 12 and 16). Similarly, as can be seen in FIGS. 6B and 6C, composite top element 20 includes a flange 201 which is formed based on the insulation 202 being provided centrally with respect to the protective layer 200. As can be appreciated from FIG. 8, screws 320 are provided, preferably in combination with washers 330 and these are inserted through the protective layer 200, through the thermally insulating layer 202 and into a top end of the tie means 40.

As can be seen in FIG. 3, the hinge support layer 184 provide support fastening elements 55 (such as screws or bolt nut arrangements) allowing the attachment of at least one hinge 56. Preferably two hinges are provided such that for convenience, the hinge support 184 extends generally between the two tie elements 40. In a similar manner, and as can be seen in FIG. 3, a handle support element 144 is provided with the composite side element 14. This, for example, can be used to provide one or more handles 52 and 54 which are connected to the composite structure by fastening elements 51. Again, screws may be used or a nut and bolt arrangement.

As can been seen in FIG. 9, a gasket 50 is provided to provide a seal between the cover and the attic opening structure or the attic floor.

FIG. 11 shows an alternate embodiment wherein the fastening arrangements are provided as an exterior tie means 80. Tie means 80 is provided as a plurality of bracket elements including comer bracket element 82 and 90° edge elements 84. The corner bracket elements 82 provide a single structural element which covers a comer edge portion of each of three different composite elements such as composite element 12, 18, and 20 or another combination of an end element, a side element and the top element. With this embodiment, the interior tie means 40 is not required. Nevertheless, the composite elements are connected without the insulation element providing any strength to the overall modular unit. The exterior tie element 80 is connected to the modular elements by fastening means 88 which is a screw into the outer protective layers 120, 140, 160, 180, and 200. Note it is possible to use both interior and exterior tie means 40 and 80.

METHOD OF ASSEMBLY AND SHIPPING

According to another feature of the invention, a method is provided for assembling an attic opening cover and for shipping composite elements which may later be connected to form the composite modular unit 10.

The method comprises providing protective elements 120, 140, 160, 180 and 200 which are preferably plywood or some other convenient material. This layer for example may be a hard plastic or even a plastic based on recycled plastic (a softer yet substantially rigid plastic). Thermal insulating layers 122, 142, 162, 182 and 202 (made e.g. from OWENS CORNING FOAMULA R 150, 2' EXTRUDED POLYSTYRENE INSULATION, A260 9225 R-VALUE 10 or Celotex Tuff-R, Insulating Sheathing, R-Value 14.4.) are connected to the respective protective layers 120, 140, 160, 180, 200. The connection may be via a suitable adhesive to provide a bond between the thermal insulating layer and the protective layer. Similarly, the hinge and handle support layers 184 and 144 may be bonded to the thermal insulating layers 182 and 142. After this bonding process is completed, two pre-fabricated composite end elements 12 and 16 are provided. The screws or fastening elements 312 and 316 are then inserted, with washers 330 to provide a pre-fabricated assembly.

The bonded elements 180, 182 and 184 are combined with the tie elements 40 (according to a first embodiment of the invention) via screws or bolts 318 and washer 330 to provide a second composite pre-fabricated side element 18. Similarly, a first composite pre-fabricated side element 14 is provided by connecting the tie elements 40 to the bonded pre-fabricated elements 140, 142, and 144. Screws 314 and washers 330 are provided. Together with the pre-fabricated top element 20, the various pre-fabricated elements and pre-fabricated assemblies may be provided in a box with all of the elements laid flat to facilitate the shipping. This may be accomplished for example by providing the top pre-fabricated element 20 with the various elements laid flat and surrounding this top element whereby the length and width dimension is approximately equal to the length and width of the top element 20. Another method of shipping would be to use three different boxes, with the top element in one box, the two end elements being parallel in a second box, and the two side elements being parallel in the third box. Spacers could be added to the boxes to protect the flanges.

The method of assembly further comprises connecting the composite side pre-fabricated element 12 via the screws 312 to the tie elements 40 of the first composite pre-fabricated side element 14 and second composite pre-fabricated side element 18, and connecting the second composite pre-fabricated end assembly 16 to the tie elements 40 of the first composite pre-fabricated side element 14 and the second composite pre-fabricated side element 18. This provides a rectangular arrangement. The pre-fabricated top element or the pre-fabricated top element assembly (including the screws 320 and washers 330 can then be positioned on top of the rectangular sub-assembly with the screws 320 being driven into the top of the tie elements 40. Preferably the pre-fabricated side assemblies already include the handles 52 and 54, the fasteners 51 and the hinges 56 with fasteners 55.

The pre-fabrication of parts, shipping and assembly provide significant advantages including the ability to perform all manufacturing steps which are machinery or labor intensive, at a pre-fabrication assembly wherein pre-fabricated units which can lie flat are provided. These units are subsequently placed in a container wherein the largest dimension is the dimension of the protective element and insulation (such as the dimension of the protective element and thermal insulating element which form the pre-fabricated composite top element, or assembly) and pre-fabricated side elements or the maximum dimension can be based on the dimension measured based on the width of the protective element, thermal insulating element and the tie element of the composite pre-fabricated side assemblies. This relatively flat package can be shipped to the destination for use wherein the further assembly steps are extremely simple. For further compactness during shipping, the tie elements 40, handles 52 and 54, and hinges 56 can be separated from the rest of the unit and fitted in otherwise empty space of the shipping arrangement.

The assembly of this device according to the second embodiment of the invention is quite similar to the assembly of the device according to the first embodiment of the invention. A plurality of pre-fabricated end elements 12 and 16 as well as composite pre-fabricated side elements 14 and 18 (however no interior tie means 40 needs to be provided). The side elements 14 and 18 may also be provided with the handles 52 and 54, and hinges 56 in place or separated. For further compactness during shipping, tie elements 40, handles 52 and 54, and hinges 56 can be separated from the rest of the unit and fitted in otherwise empty space of the shipping arrangement. A pre-fabricated top element 20 is also provided. These elements are laid flat wherein the maximum dimension here is based on the width of the composite, namely the width of the protective layer and the width of the thermal insulating layer. The various exterior tie elements and fasteners are disposed in the same container and do not add to the dimension. The pre-fabricated elements are then shipped in a flat state to the location for use. The subsequent assembly process merely involves positioning the tie elements including the corner edge tie elements (4 of them) and the various edge tie elements 84 (such as 8 edge tie elements 84). The fasteners 88 are then used to connect the protective layers.

While specific embodiments of the invention have been shown and described in detail to illustrate the application of the principles of the invention, it will be understood that the invention may be embodied otherwise without departing from such principles.

What is claimed is:

1. An attic opening cover, comprising:

a first composite end element including a protective layer bonded to a thermally insulating layer;

a second composite end element including a protective layer and a thermal insulating layer;

a first composite side element including a protective layer bonded to a thermal insulating layer;

a second composite side element including a protective layer bonded to a thermal insulating layer;

a composite top element including a protective layer bonded to a thermal insulating layer; and a fastening arrangement including fasteners extending through said first composite end element, fasteners extending through said second composite end element, fasteners extending through said first composite side element, fasteners extending through said second composite side element and fasteners extending through said composite top element and tie means including a plurality of tie elements, each tie element being connected to fasteners of one of said first and second composite end element, one of said first and second composite side element and said top element for joining together the protective layers of said one of said first and second composite end element, said one of said first and second composite side element and said top element.

2. The cover according to claim 1, wherein said tie means includes four tie elements disposed on an interior side of said unit.

3. The cover according to claim 1, wherein said tie means includes four corner tie elements and 8 edge tie elements disposed on an exterior of said unit.

4. The cover according to claim 1, wherein said first side element further comprises an interior support layer and a handle with fastening elements passing through said protective layer of said first side element and said interior support layer.

5. The cover according to claim 1, wherein said second side element further comprises an interior support layer and a hinge with fastening elements passing through said protective layer of said second side element and said interior support layer.

6. The cover according to claim 1, wherein said plurality of tie elements include first and second tie elements connected by said fastening elements to said first composite side element to form a first composite side element assembly and third and forth tie elements connected by said fastening elements to said second composite side element to form a second composite side element assembly.

7. The cover according to claim 1, wherein said first composite side element and said second composite side element each includes side flanges and said composite top element includes a flange formed about a periphery of said composite top element thermal insulating member.

8. A process for providing an attic cover, the process comprising with steps of:

bonding a thermal insulating member to a protective member to form a first composite end element;

bonding a thermal insulating member to a protective member to form a second composite end element;

bonding a protective member to an insulating member to provide a first composite side element;

bonding a protective member to an insulating member to provide a second composite side element;

bonding an insulating member to a protective member to form a composite top element;

providing tie means including a plurality of tie elements;

connecting a first tie element and a second tie element to said first composite side element to form a first composite side assembly;

connecting a third tie element and a forth tie element to said second composite side element to provided a second composite side element assembly;

providing a box;

disposing said composite top element, said first composite end element, said second composite end element, said first composite side assembly and said second composite side assembly in said box, disposed substantially flat to provide positioned composite elements and composite assemblies having a minimum height;

shipping the box with positioned composite elements and composite assemblies to a location; and fastening said first composite end element to said first tie element and said second tie element and connecting said second composite end element to said third tie element and said fourth tie element and connecting said composite top element to each of said first tie element, said second tie element, said third tie element and said fourth tie element.

9. Process according to claim 8, wherein a length dimension of said box is equal to a length dimension of said first composite side assembly.

10. The process according to claim 8, wherein said maximum height is equal to a height dimension of one of said first composite end element, said second composite end element, said first composite side element, said second composite side element and said composite top element.

11. The process according to claim 8, wherein said first composite side element and said second composite side element are provided with the side flanges and said composite top element is provided with a flange provided around a periphery of said thermal insulating member of said composite top element.

12. The process according to claim 10, wherein said first composite side element and said second composite side element are provided with the side flanges and said composite top element is provided with a flange provided around a periphery of said thermal insulating member of said composite top element plus a width dimension of one or more of said flanges.

13. An insulating enclosure for attic passageway apparatus, the enclosure comprising:

a first composite end element including a protective layer bonded to a thermally insulating layer;

a second composite end element including a protective layer and a thermal insulating layer;

a first composite side element including a protective layer bonded to a thermal insulating layer;

a second composite side element including a protective layer bonded to a thermal insulating layer;

a composite top element including a protective layer bonded to a thermal insulating layer, said protective layers and said insulating layers of all of said elements being planar, said protective layers providing a majority of structural strength and rigidity to the enclosure, said insulating layers providing a majority of thermal resistance to the enclosure; and, a plurality of fastening means for connecting a plurality of edges of said protective layers to each other into a box shape with an open side, said box shape having an inside space for receiving and covering the attic passageway apparatus, said fastening means including fasteners extending into and fixed to said protective layers and tie means for rigidly connecting said fasteners.

* * * * *